US005732797A

United States Patent [19]

Giorgioni

[11] Patent Number: 5,732,797

[45] Date of Patent: Mar. 31, 1998

[54] SAFETY RELEASE DEVICE OPERATING IN A LINEAR BELT TRANSMISSION FOR AUTOMATICALLY-OPENING LIFT AND ELEVATOR GATES

[75] Inventor: Paolo Giorgioni, Ligonchio, Italy

[73] Assignee: Selcom S.p.A., Colorno, Italy

[21] Appl. No.: 821,973

[22] Filed: Mar. 18, 1997

Related U.S. Application Data

[63] Continuation of PCT/IT95/00058 Apr. 21, 1995.

[30] Foreign Application Priority Data

Sep. 30, 1994 [IT] Italy ..... PR94A0037

[51] Int. Cl.[6] ..... B66B 13/14

[52] U.S. Cl. ..... 187/314; 187/335

[58] Field of Search ..... 187/313, 314, 187/316, 317, 334, 335, 331; 49/116, 120

[56] References Cited

U.S. PATENT DOCUMENTS 5,213,182 5/1993 Guckert et al. ..... 187/56

FOREIGN PATENT DOCUMENTS 0 543 523 5/1993 European Pat. Off. .

2 514 764 10/1975 Germany .

663 608 12/1987 Switzerland .

WO 93/23 324 11/1993 WIPO .

*Primary Examiner*—Kenneth Noland

*Attorney, Agent, or Firm*—Darby & Darby

[57] ABSTRACT

The invention relates to a safety device for gates of lifts and elevators comprising a release device (4) which, when a door of the lift gate is closing and meets an obstruction, causing an excessive resistance to the movement thereof according to a prefixed resistance threshold value, releases the coasters (6) bearing the door from means for moving thereof such as to cause said coasters (6), and in consequence said door, to stop, while said means for moving said door remains activated. The release device (4) is a completely mechanical safety device.

7 Claims, 2 Drawing Sheets

FIG.2
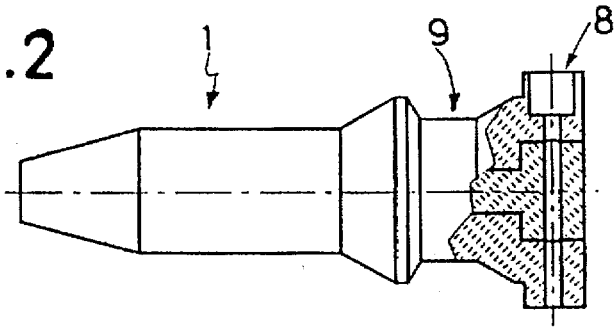
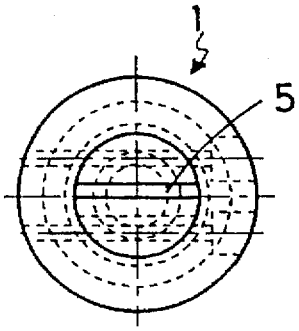
FIG.4
FIG.3
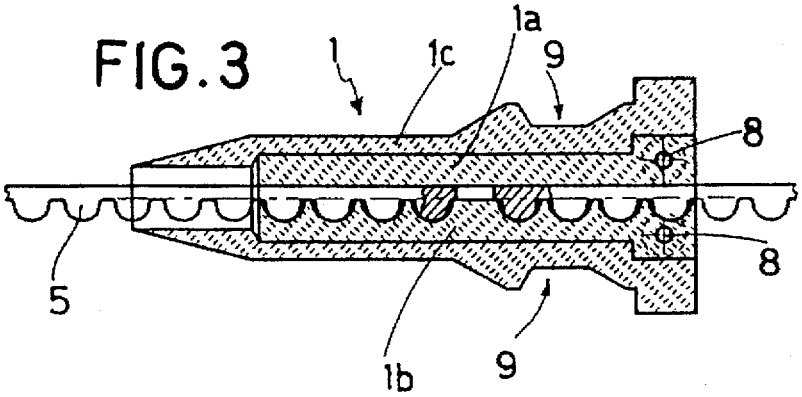
FIG.6
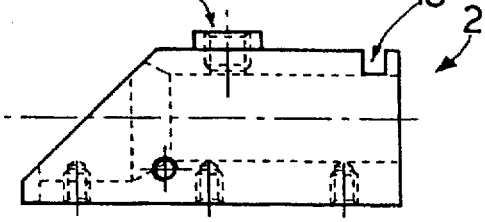
FIG.7
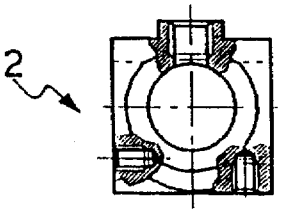
FIG.5
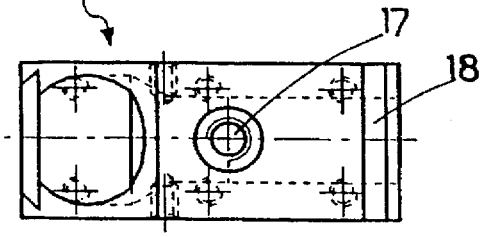

SAFETY RELEASE DEVICE OPERATING IN A LINEAR BELT TRANSMISSION FOR AUTOMATICALLY-OPENING LIFT AND ELEVATOR GATES

This is a continuation of PCT/IT95/00058, Apr. 21, 1995.

BACKGROUND OF THE INVENTION

The invention relates to a safety release device operating in a linear belt or cable transmission for lift gates and for automatically opening lifts and elevators. In lifts and elevators having gates with two or more centrally-opening doors or telescopically-opening lateral segments, the opening operation is generally driven by a motor which sets a pulley in rotation. A belt or closed cable is wound about the pulley to create the movement which sets the coasters bearing the doors in motion.

Said coasters are anchored to the belt or cable, either directly or by means of intermediate elements, such that each rotation direction of the belt or cable corresponds to a reciprocal nearing or distancing of the coasters and thus an opening or closing of the doors.

If an obstacle, usually a person, should obstruct the doors when closing, a safety release device is provided which stops the motor and is also able to reactivate the doors in the opposite direction.

In the case of linear belt or chain drive, generally a continuous sensor of the motor power request is provided, and whenever the request passes a predetermined threshold value, the motor is stopped.

In a different solution, a continuous reading is taken of the revolutions of the motor, and as soon as the number thereof drops below a prefixed value, the motor is stopped.

The above-described safety devices, though normally functioning efficiently, have the drawback of being of an electrical or electronic kind, which when there is a fault in the command logic, or a technical breakdown in an electrical or electronic component, can lead to injuries to people caught between the doors during a closing operation, and also to motor breakdown due to excessive overheating thereof.

Also well known are transmissions making use of lever arrangements to move the coasters instead of using belts, chains or cables. These mechanical safety devices are however inapplicable to doors having linear belt, chain or cable drive since the door-opening mechanisms are considerably different.

SUMMARY OF THE INVENTION

The main aim of the present invention is to eliminate the above-mentioned drawbacks and provide a safety device of an exclusively mechanical type, and which is therefore not subject to breakdowns due to electrical or electronic faults, and which can be applied in automatically-opening doors of the belt, chain or cable linear transmission type.

Said aims are fully attained by the safety release device object of the present invention, which is characterized as in the following claims, and in particular in that said release device is shaped such that, during the door-closing phase, when a predetermined resistance threshold encountered by the doors is exceeded, the door-bearing coasters are freed from their belt or cable and thus stop, while the belt or cable continues to function.

The safety device, one for each gate, is stably anchored to the coaster and therefore to the chain or cable by means for maintaining a pressure which enable the coaster to be released from the cable or belt once a contrast force exerted by the means for maintaining a pressure has been overcome.

BRIEF DESCRIPTION OF THE DRAWINGS

Further characteristics and advantages of the present invention will better emerge from the detailed description that follows, of an embodiment of the invention, illustrated in the form of a non-limiting example in the accompanying drawings, in which:

FIGS. 2, 3 and 4 show a first element comprised in the device, respectively in a plan view, a median frontal section and a lateral view;

FIGS. 5, 6 and 7 show a second element comprised in the device, respectively in plan view, in frontal view and in a lateral view;

DESCRIPTION OF THE PREFERRED EMBODIMENT

Figure 1:
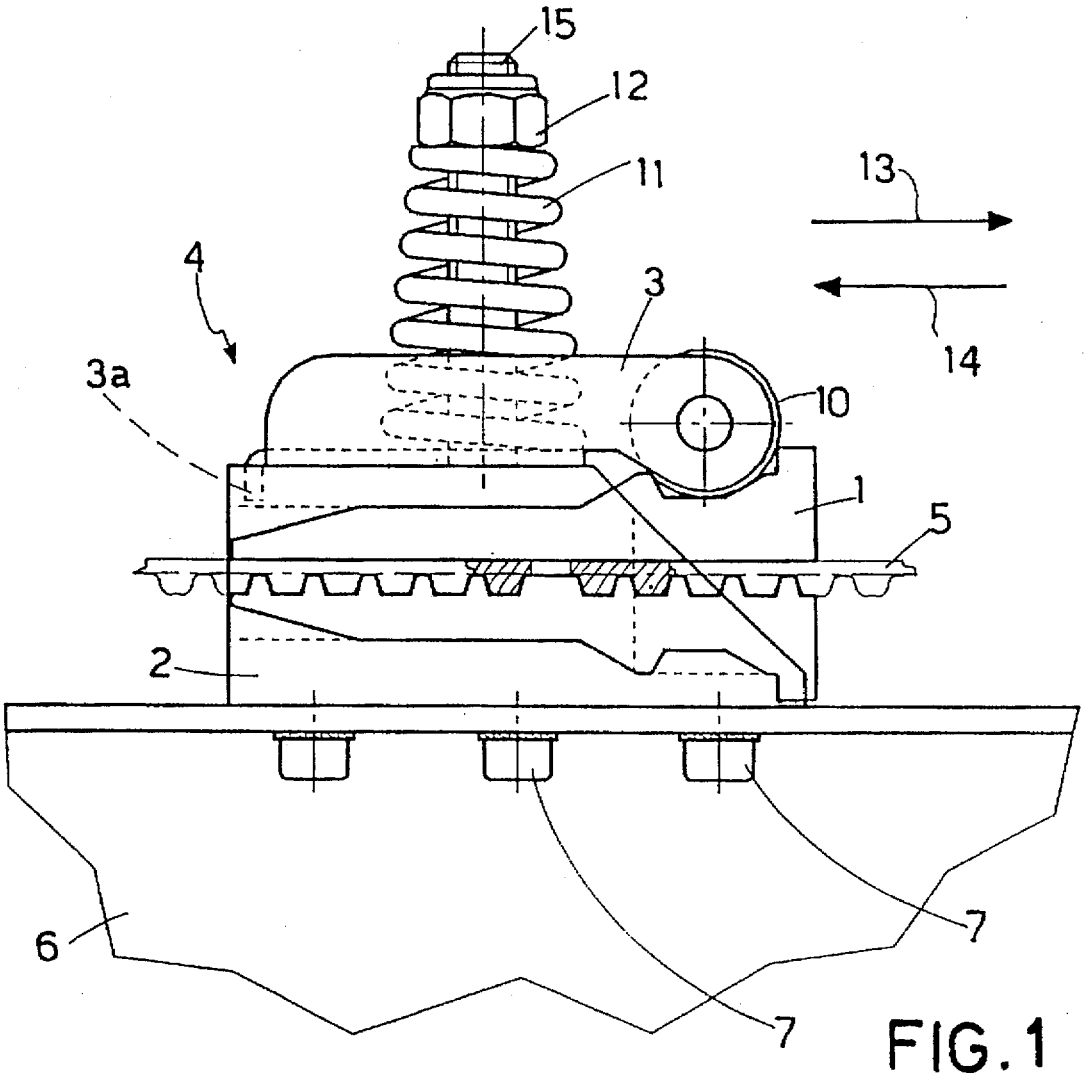
FIG. 1 shows the device in frontal view, partially sectioned.

With reference to the figures, the device of the invention, indicated in its entirety by 4, comprises a first, a second and a third elements.

1 denotes a first, internal element of the release device 4.

The release device 4 further comprises a second, external element 2 and a third element, in this embodiment a platelet 3, both of which cooperate with the internal element 1.

5 denotes a transmission belt ring-wound about a pulley pair (not illustrated), of which pulleys one is motorised while the other is idle.

The internal element 1, illustrated in greater detail in FIGS. 2, 3 and 4, is solidly constrained to the belt 5, and comprises an internal part, constituted by two shells 1*a* and 1*b* which embrace the belt 5 and insert in an external part 1*c* which envelopes the two shells 1*a* and 1*b*. The internal element 1 is fixed to the belt 5 by means of two screws (not illustrated) which insert in through holes 8 afforded by the two shells 1*a* and 1*b* and the external part 1*c*.

As is clearly evidenced in FIGS. 1 and 3, said internal element 1 also constitutes a sort of fastener for the belt, the free ends thereof being trapped internally thereof.

The internal element I is externally cylindrical with a conical end, and is specially shaped to provide a seat 9 in its lateral external surface.

The external element 2 of the release device 4, illustrated in greater detail in FIGS. 5, 6 and 7, is a hollow element, fixed by means of screws 7 to a door-bearing coaster 6, partially illustrated in FIG. 1 and of known type.

Each gate comprises a variable number of coasters 6, each of which inferiorly supports a door of a lift or elevator.

The release device 4, one for each gate, is applied on the belt 5, which might also be a cable and which constitutes means for moving the coasters 6.

The external element 2 is conformed such as to house the internal element 1, as illustrated in FIG. 1, in one sense only; it also constitutes an endrun stop for said internal element. The external 2 and internal 1 elements thus achieve a reversible male-female coupling.

Figure 8:
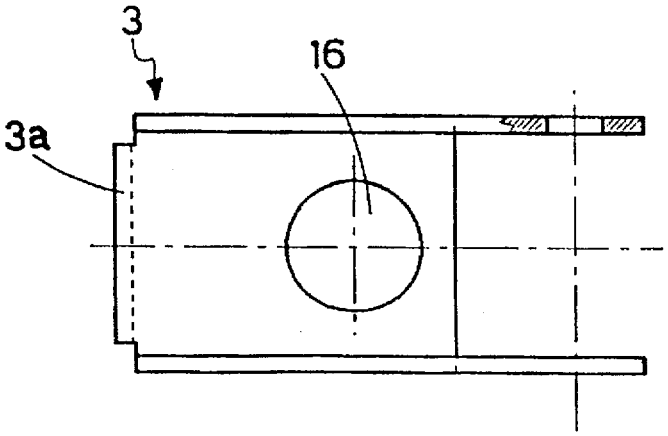
FIG. 8 is a plan view of a third element comprised in the device.

A third element making up the release device 4 is illustrated in FIGS. 1 and 8 and is constituted by a platelet 3 provided with a rounded end 3*a* for attachment of the external element 2 and an idle roller 10 destined to interact with the internal element 1 and insert thereon at the specially shaped seat 9, as can be seen in FIG. 1.

The curved end 3*a* inserts in a corresponding channel 18 exhibited by the external element 2.

A compression spring 11 acts on the platelet 3 and keeps it pressed against the internal element 1 and the external element 2 such that the idle roller 10 remains in the shaped seat 9 and constrains the coaster 6 to the belt 5, thus permitting transport of the coaster 6 and the door when the belt 5 is moved by the motor. All the coasters 6 are operatively connected to the belt 5 such that when the belt 5 rotates about the pulleys, corresponding pairs of doors either reciprocally distance or near (in doors opening centrally) or all segments in a single door move (in laterally-opening telescopic doors).

During the closing phase of the door, in which the belt 5 moves in the direction of the arrow 13, when an obstacle is encountered, for example a person, while the door is closing, the door obviously meets a certain resistance to its prescribed movement, which resistance overcomes the pressure force of the spring 11 and causes the internal element 1 to exit from its coupling with the external element 2 and the platelet 3.

More in detail, the platelet 3 lifts slightly at the rounded end 10 and allows the internal element 1 to exit from its housing in the external element 2.

This causes the door to stop without interfering with the normal functioning of the motor, which continues to turn and move the by-now unladen belt 5 up until said belt 5 reaches its endrun. At that point, a traditional microswitch or encoder system checks whether the coaster 6 has also reached its endrun. If the internal element 1 and the coaster have together reached endrun, this means that they have remained solidly constrained one to the other and that therefore the door or doors have been normally moved; while if the above is not the case, this means that a release has taken place due to an abnormal situation, and the doors are commanded to reopen through a command logic of known type which governs the door functioning.

During the reopening phase of the doors, when the belt 5 is moving in the opposite direction, indicated by arrow 14, to the closing direction, the internal element 1, due to its special conformation, automatically re-enters into the external element 2 and the roller 10 slides back into the seat of the shaped seat 9, so as to reconstitute the coupling between the belt 5 and the coaster 6.

12 denotes an adjustment nut which is screwable on a central axis 15 of the spring, which axis 15 passes through a hole 16 in the platelet 3 and screws into a blindhole 17 in the external element 2. The adjustment nut 12 serves to adjust the pressure force exerted by the spring 11 on the platelet 3 and thus to determine the intervention threshold of the release device 4.

The release device 4 of the present invention enables door movement to be stopped during the closing phase thereof by means only of mechanical components. No electrical or electronic components are needed, and a resultingly greater level of safety is guaranteed.

A further advantage of the present device is that the shells 1*a* and 1*b* of the internal element 1 also lock the free ends of the belt 5, creating in effect a closed belt which achieves the double aim of constituting pan of the release device as well as a sort of fastener for the belt 5 itself.

What is claimed:

1. A safety release device operating in a linear belt or cable transmission for opening lift and elevator gates in lifts and elevators having at least one door, comprising at least one linearly-mobile door-bearing coaster (6) able to move in two directions to open or close the door and being operatively connected to means for moving said coaster (6) and therefore said door, which means for moving said coaster (6) comprises a belt or a cable (5);

wherein said safety release device further comprises a release device (4) applied to said belt or cable (5), which release device (4), during a closing movement of the door, upon meeting a resistance to said closing movement releases the coaster (6) from the belt (5) such as to cause the coaster (6) and the door to stop while not stopping movement of the belt (5);

said release device (4) comprising at least an element which is stably anchored to a coaster (6) and an element which is stably anchored to the belt (5); means for maintaining a pressure being provided for maintaining a coupling between said elements under normal functioning conditions of the lift and for freeing said coupling by releasing the coaster (6) from the belt (5) whenever a force is exerted on said coaster (6) which overcomes a contrast force exerted thereon by said means for maintaining a pressure.

2. A device as in claim 1, wherein the safety release device includes:

an internal element (1) fixed stably to the cable (5);

an external element (2) solidly constrained to the coaster (6) and conformed such as to afford a seat for the internal element (1):

a platelet (3) which interacts with the internal element (1) and the external element (2) to maintain the coupling therebetween and allowing a release of said coupling; said platelet (3) being forced against said internal element (1) and said external element (2) by said means for maintaining a pressure.

3. A device as in claim 2, wherein the means for maintaining a pressure are constituted by a compression spring (11).

4. A device as in claim 3, including an adjustment nut (12) which screws on a central axis (15) of the spring (11) to adjust a force exerted by said spring (11) on the platelet (3).

5. A device as in claim 2, wherein the external element (2) is conformed such as to be penetrable by the internal element (1) in only one direction; said external element (2) thus functioning as an endrun striker for said internal element (1).

6. A device as in claim 1, wherein the internal element (1) is constituted by two shells (1*a*, 1*b*) which embrace the belt (5) and insert in an external part (1*c*) of said internal element (1) that envelopes said two shells (1*a*, 1*b*); said two shells (1*a*, 1*b*) embracing the belt (5) at two free ends of said belt (5) such as to constitute a fastener therefor.

7. A device as in claim 1, wherein the release device (4) is conformed such as to constitute a fastener for the two free ends of the belt (5).

* * * * *